US006244339B1

(12) United States Patent
Buytaert

(10) Patent No.: US 6,244,339 B1
(45) Date of Patent: Jun. 12, 2001

(54) APPARATUS FOR AND A METHOD OF DRILLING A LATERAL BOREHOLE

(75) Inventor: Jean Paul Buytaert, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/445,790

(22) PCT Filed: Jun. 15, 1998

(86) PCT No.: PCT/GB98/01742

§ 371 Date: Apr. 21, 2000

§ 102(e) Date: Apr. 21, 2000

(87) PCT Pub. No.: WO98/58151

PCT Pub. Date: Dec. 23, 1998

(30) Foreign Application Priority Data

Jun. 14, 1997 (GB) ..... 9712393

(51) Int. Cl.[7] ..... E21B 7/06
(52) U.S. Cl. ..... 166/255.2; 166/117.5
(58) Field of Search ..... 166/117.5, 117.6, 166/313, 255.2, 255.3; 175/77

(56) References Cited

U.S. PATENT DOCUMENTS

| | | | | |
|---|---|---|---|---|
| 5,398,754 | * | 3/1995 | Dinhoble | 166/117.6 |
| 5,411,082 | * | 5/1995 | Kennedy | 166/181 |
| 5,427,177 | * | 6/1995 | Jordan, Jr. et al. | 166/50 |
| 5,458,209 | * | 10/1995 | Hayes et al. | 175/61 |
| 5,579,829 | * | 12/1996 | Comeau et al. | 166/117.6 |
| 6,138,761 | * | 10/2000 | Freeman et al. | 166/313 |

FOREIGN PATENT DOCUMENTS

WO 96 23953 8/1996 (WO) .

* cited by examiner

*Primary Examiner*—Frank Tsay
(74) *Attorney, Agent, or Firm*—Howrey Simon Arnold & White, LLP

(57) ABSTRACT

An apparatus and method of drilling and lining a lateral borehole, the apparatus comprising first and second casing sections joined at an obliquely angled rotatable joint allowing the two sections to be rotated relative to one another so that the longitudinal axis of the first section extends through a window on the second section.

14 Claims, 12 Drawing Sheets

APPARATUS FOR AND A METHOD OF DRILLING A LATERAL BOREHOLE

FIELD OF INVENTION

The invention relates to apparatus for and a method of drilling and production of a lateral well, and more particularly but not exclusively to the drilling and production of multi-lateral wells from a single mother well.

BACKGROUND OF THE INVENTION

The demand for multi-lateral drilling is increasing as more horizontal wells are being used on development wells to improve reservoir drainage and productivity. Drilling multi-lateral wells provides the advantage that the productivity or recovery of hydrocarbons from a formation can be improved by drilling a number of branch wells, all of which feed a mother well. Drilling multi-lateral wells can also reduce the platform cost by reducing the number of slots required to exploit a given hydrocarbon formation.

In order to drill a multi-lateral well, it is known to mill a window in the casing of the mother well, and deflect a drilling tool through the window to drill the lateral well by using a deflection tool which is commonly known as a "whipstock".

By using this conventional technique, lateral wells can be completed "barefoot" (that is no loner pipe is used to case off the lateral well). Barefoot completions are only satisfactory where the formations drilled are suitable for such a completion (such as a limestone formation).

However, where sands are encountered in the pay zone of the formation, which is very common, the well must be cased and perforated to allow production of the hydrocarbons to take place without the lateral well "sanding off" or collapsing. In addition, many wells are geo-pressured which requires that the well is cased off and a pressure seal is effected at the junction of the lateral well liner and the mother well casing. Conventionally, cement is used to effect the pressure seal at the junction. However, cement seals may be relatively unreliable or create a relatively low pressure resistant seal.

In order to insert casing into the lateral well, several techniques are known. For instance, it is known to have a casing with a section of side wall which incorporates an outlet tube and which is pivotably coupled to the casing by a hinge mechanism. The pivotable section is moveable from a first position in which the outer surface of the casing is cylindrical and the inner bore of the casing is substantially narrowed by the outlet tube; and a second position in which the inner bore of the casing is cylindrical and the outlet tube protrudes from the casing.

However, this type of arrangement has the disadvantage that the diameter of the lateral well is limited with respect to the diameter of the mother well due to the pivotable outlet tube arrangement, as it must be contained within the main casing during installation.

A further disadvantage in the drilling of lateral wells from a mother well is that the maximum bend for conventional drilling assemblies is about 15 degrees per hundred feet. Thus, the initial (maximum) deviation angle of a lateral well from the mother well is limited to approximately 4° to 5°. This angle limitation therefore requires a large window in the side of the casing through which the drilling assembly will exit the casing, and this window may typically be 12 feet long.

SUMMARY OF THE INVENTION

In accordance with a first aspect of the present invention, there is provided apparatus for drilling a second borehole from a first borehole comprising a first casing section and a second casing section, the first and second casing sections being rotatably coupled to each other by a rotatable joint, such that the first and second casing sections may be rotated about the joint from a first position, in which the longitudinal axes of the first and second casing sections are substantially coincident, to a second position in which the longitudinal axis of the first and second casing sections are at a mutually oblique angle, and such that the longitudinal axis of one of the casing sections extends through an aperture in the other casing section when the casing sections are in the second position.

Preferably, the plane of the rotatable joint is at an oblique angle to the longitudinal axis of the casing string adjacent the joint.

In accordance with a second aspect of the present invention, a method of drilling a second borehole from a first borehole comprises inserting a casing string comprising a first casing section and a second casing section into the first borehole with the longitudinal axes of the first and second casing sections substantially coincident, rotating the first and second casing sections relative to each other to move the second casing section to a position in which the longitudinal axis of the second casing section is at an oblique angle to the longitudinal axis of the first casing section; inserting a drilling device into the first casing section and causing it to pass into the second casing section, and drilling the second borehole from the second casing section.

A liner can be subsequently inserted into the second borehole and coupled to the second casing section.

Preferably, the apparatus further comprises a third casing section adapted to be inserted through the said one casing section into the other casing section and exit the other casing section through the aperture in the other casing section when the casing sections are in the second position. Preferably, the third casing section is inserted before the second borehole has been drilled typically after the installations of the first and second casing sections.

Typically the aperture in the second casing section and/or the aperture in the third casing section (if present) may be provided with sealing means. The sealing means may be provided by an elastomeric seal, a metal to metal seal or a seal which is energised when the liner is inserted into the second borehole.

Preferably, the method further includes the initial step of under-reaming a section of the first borehole at which the apparatus is to be located prior to inserting the apparatus into the first borehole.

Preferably, the drilling device is diverted into the second casing section by a diversion device, such as a whipstock, located in the third casing section. Typically, the diversion device is removable from the third casing section after the second borehole has been drilled.

DESCRIPTION OF THE PREFERRED EMBODIMENTS

Examples of an apparatus for and a method of drilling and lining a second borehole from a first borehole will now be described with reference to the accompanying drawings.

Figure 1:
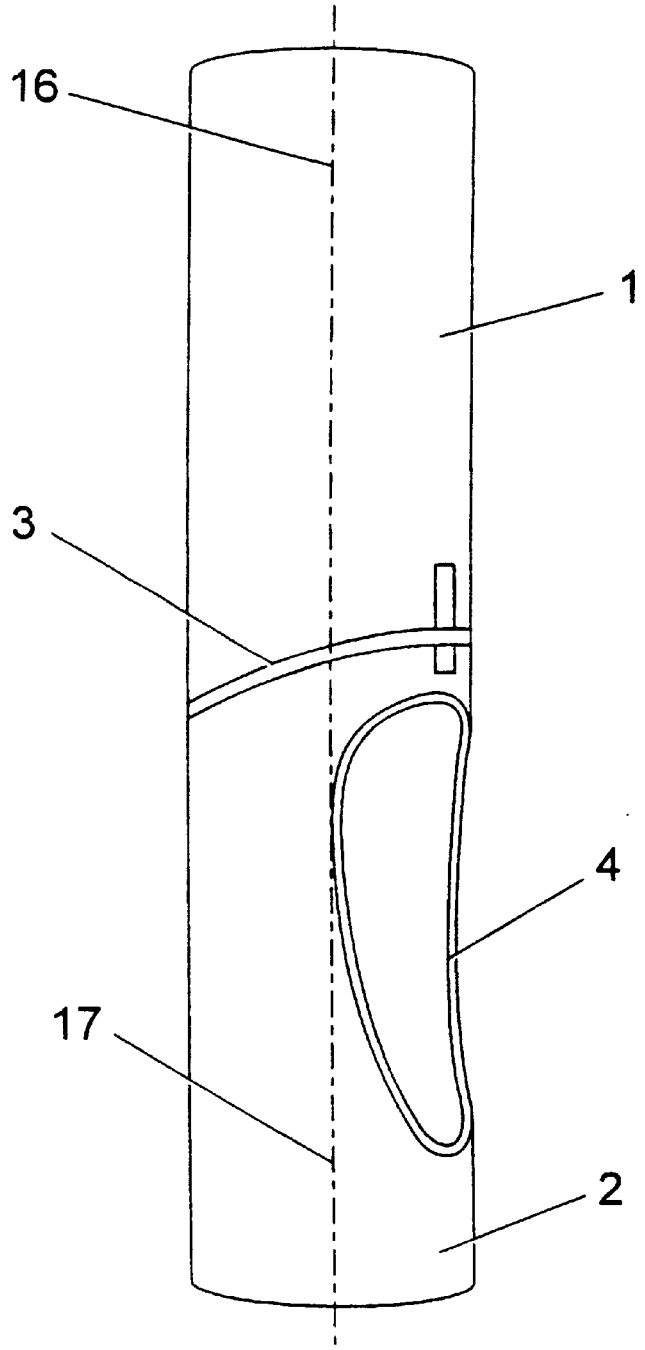
FIG. 1 is a perspective view of first and second casing sections rotatably coupled together in a first position.

FIG. 1 shows a first casing section 1 which is rotatably coupled to a second casing section 2 by a rotatable joint 3. The plane of the rotatable joint 3 is at an oblique angle to the longitudinal axes 16, 17 of the casing sections 1, 2. Thus, when the first casing section 1 is held stationary at the second casing section 2 rotated through 180° relative to the first casing section 1, the second casing section moves to the position shown in FIG. 2. The second casing section 2 has an aperture 4 therein. Thus, when the casing sections 1, 2 are in the position shown in FIG. 2, the longitudinal axis 16 of the first casing section 1 extends through the aperture 4.

Figure 2:
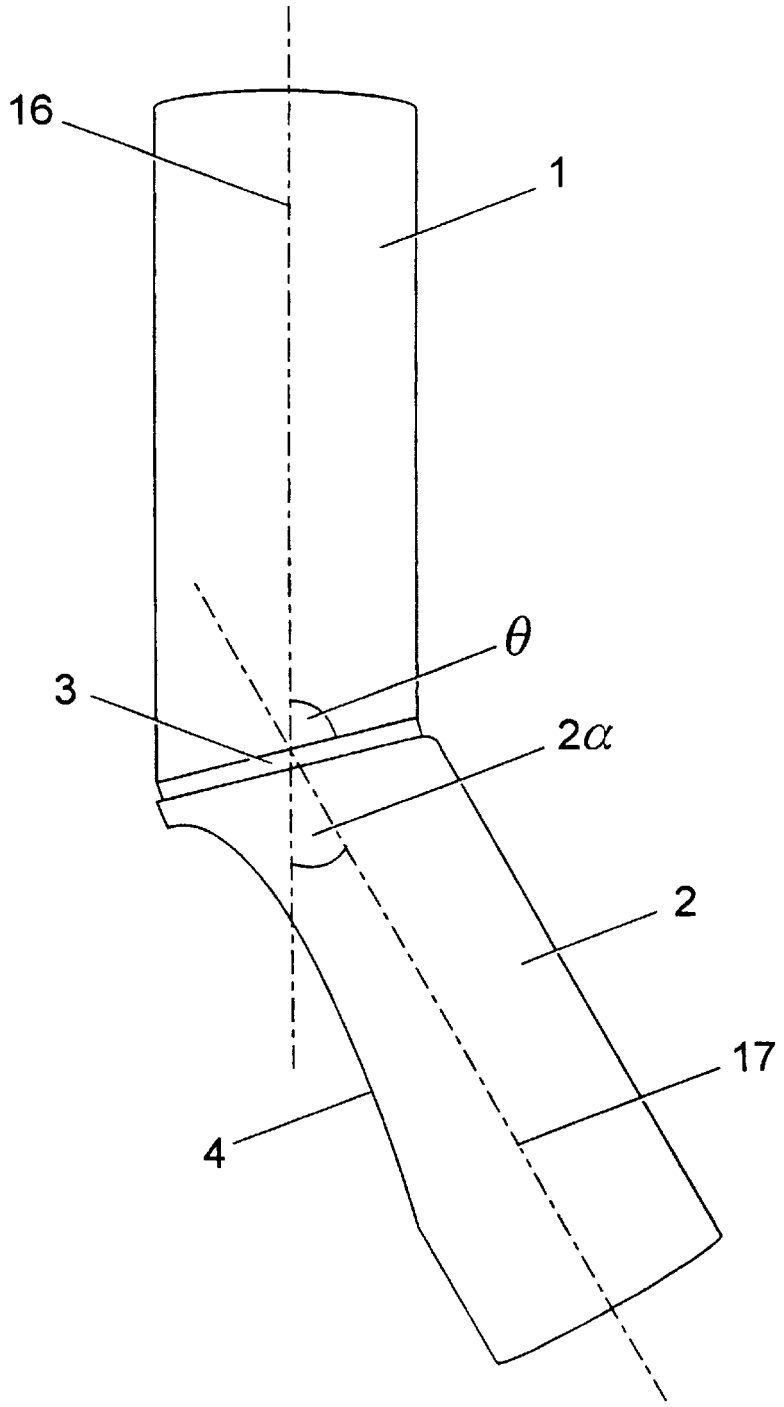
FIG. 2 is a side view of the casing sections of FIG. 1 in a second position.

When the first and second casing sections 1, 2 are in the second position shown in FIG. 2, the longitudinal axis 17 of the second casing section is at an angle $2\alpha$ to the central longitudinal axis 16 of the first casing section. If the plane of the rotatable joint 3 is at an angle $\theta$ to the central longitudinal axis 16, then the angle $\alpha=90°-\theta$ and $2\alpha=2(90°-\theta)$. Typically, the angle $\theta$ is chosen so that $2\alpha$ is approximately 4° to 5°. Therefore the angle $\theta$ is approximately 87.5° to 88°.

Figure 3:
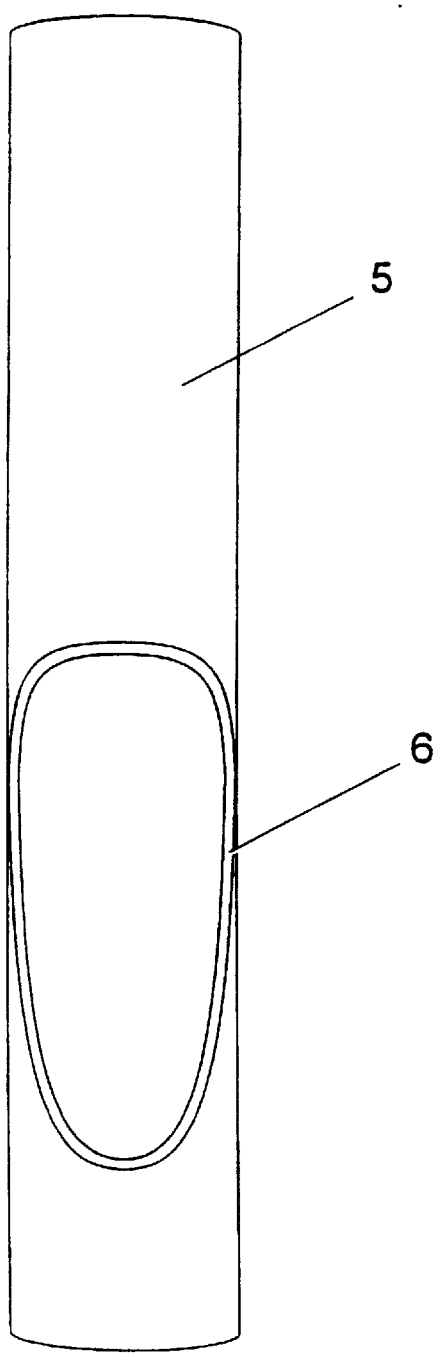
FIG. 3 is a front view of a third casing section for use with the casing sections shown in FIGS. 1 and 2.
Figure 4:
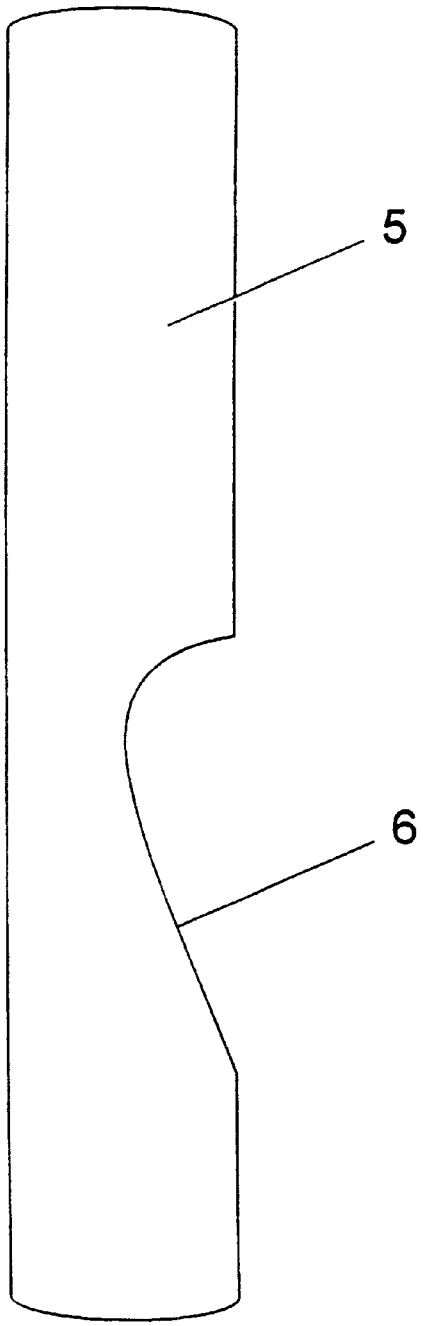
FIG. 4 is a side view of the third casing section shown in FIG. 3.
Figure 5:
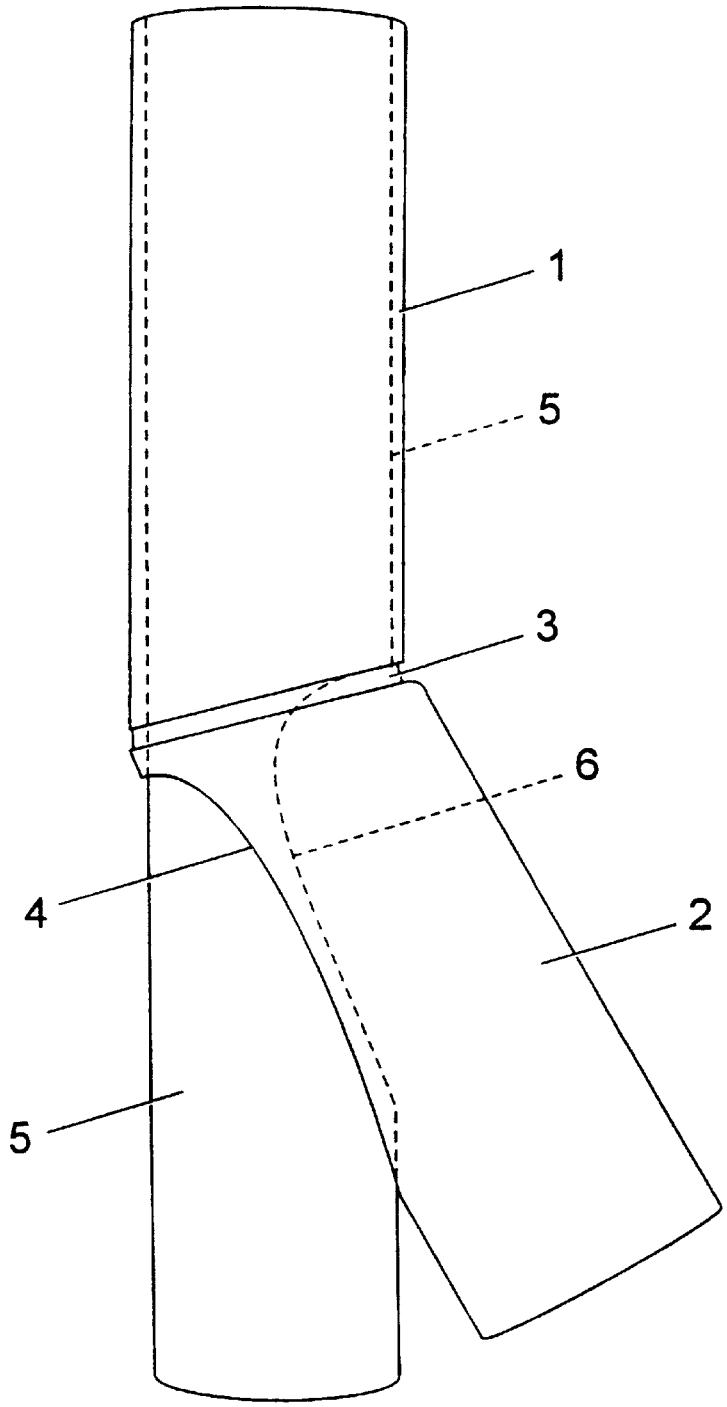
FIG. 5 is a side view of the first and second casing sections in the position shown in FIG. 2 with the third casing section shown in FIGS. 3 and 4 inserted into and through the first and second casing sections.

FIGS. 3 and 4 show a third casing section 5 which includes an aperture 6 in the side wall of the casing section 5. The outer diameter of the third casing section 5 is less than the internal diameter of the first casing section 1. Hence the third casing section 5 may be inserted through the first casing section 1 to extend through the aperture 4 in the second casing section 2, as shown in FIG. 5. In this position, the aperture 6 in the third casing section 5 provides an opening into the second casing section 2.

Typically, the faces of the apertures 4, 6 are provided with sealing means (not shown) so that when in the position shown in FIG. 5, the aperture 6 seals against the inside of the second casing section 2 and the aperture 4 seals against the outside of third casing section 5.

Figure 6:
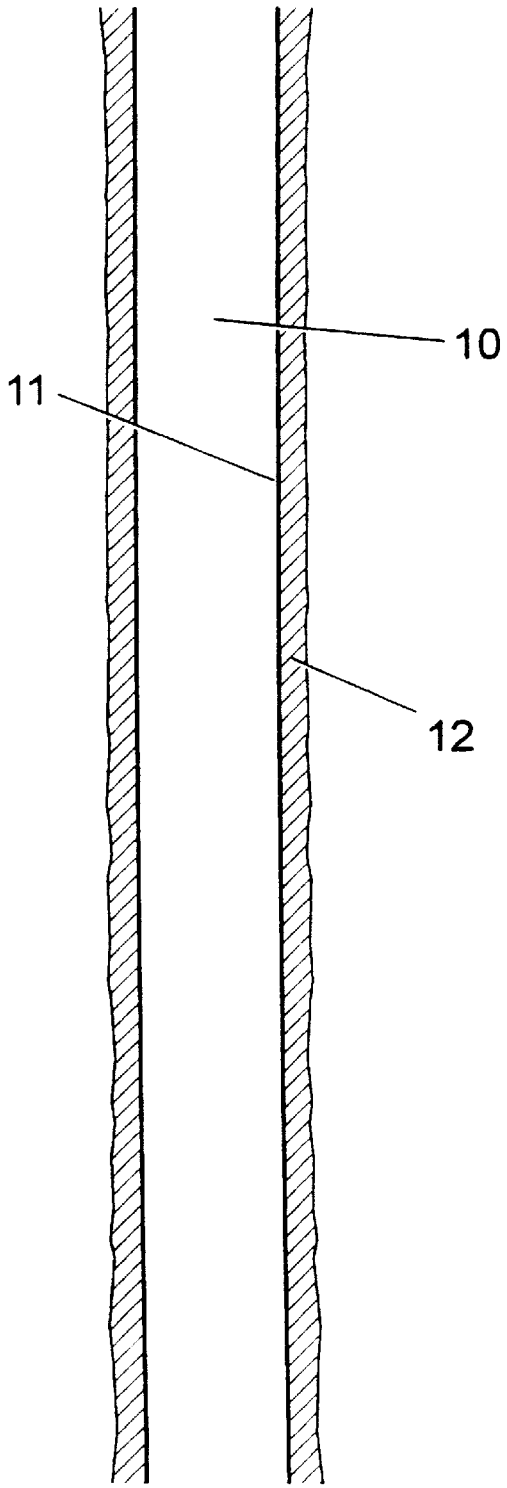
FIG. 6 is a cross-sectional view through a first borehole lined with casing.
Figure 7:
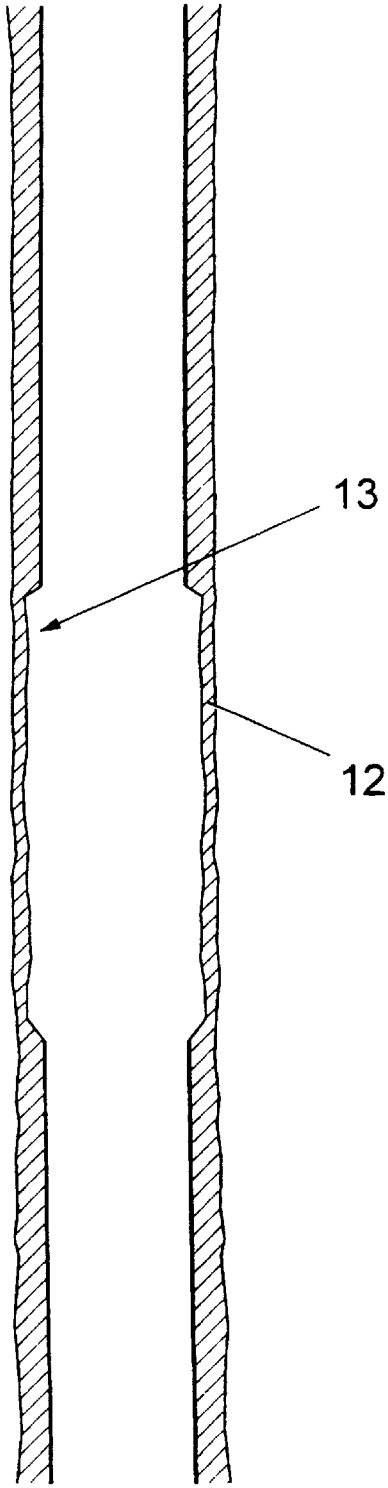
FIG. 7 shows the first borehole with a section of the casing milled out.
Figure 8:
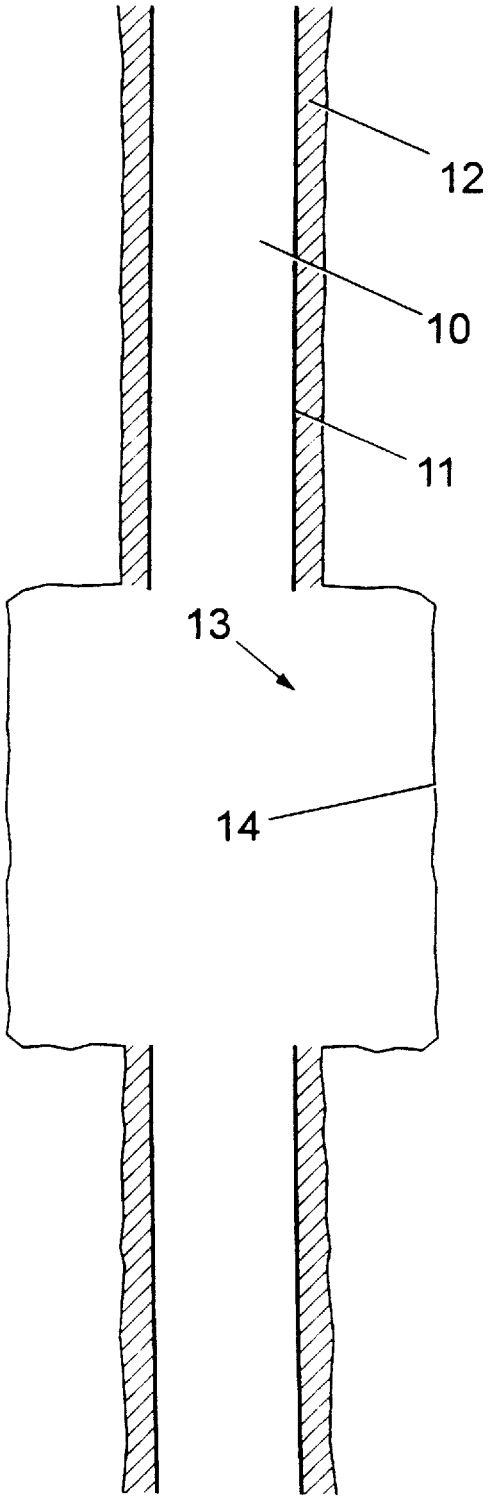
FIG. 8 shows the first borehole with a section of the borehole adjacent the milled casing under-reamed.
Figure 9:
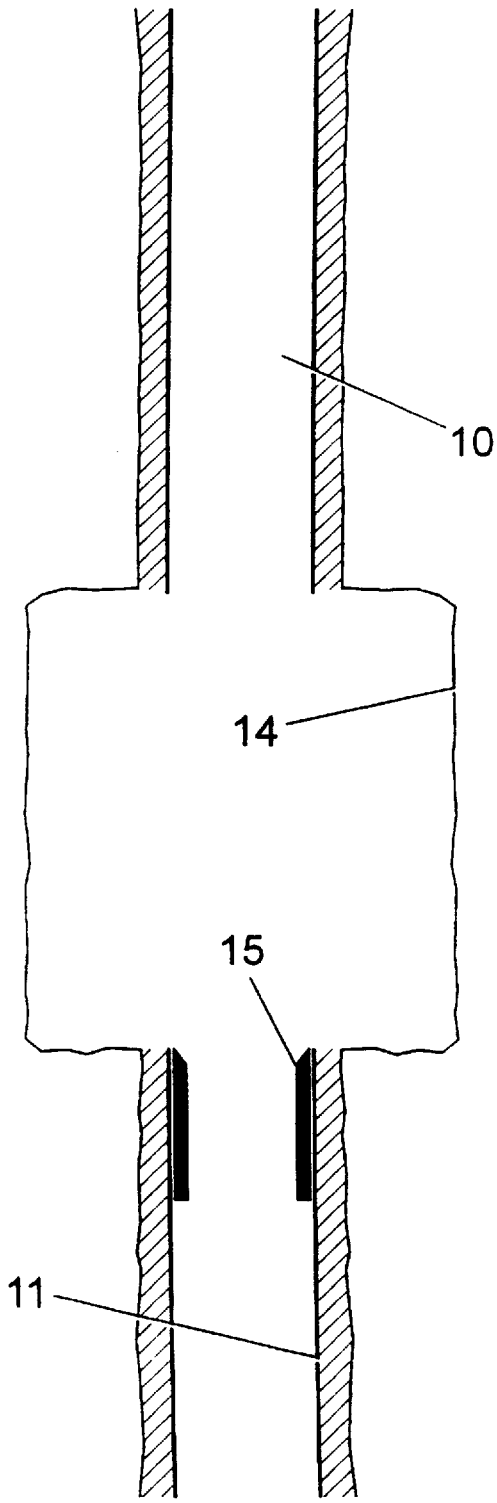
FIG. 9 shows the first borehole of FIG. 8 with a pack-off receptacle inserted below the under-reamed section of the borehole.

In a multi-lateral installation or a single lateral installation, a first borehole 10 (see FIG. 6) is lined with casing 11. As shown in FIG. 7, a section of the casing 11 is milled out using an appropriate downhole tool in order to expose the formation 12. The formation 12 is then under-reamed as shown in FIG. 8 to form an under-reamed section 14 within the borehole 10. A pack-off receptacle 15 is then inserted and secured to the casing 11 below the under-reamed section 14 of the borehole 10 (see FIG. 9).

Figure 10:
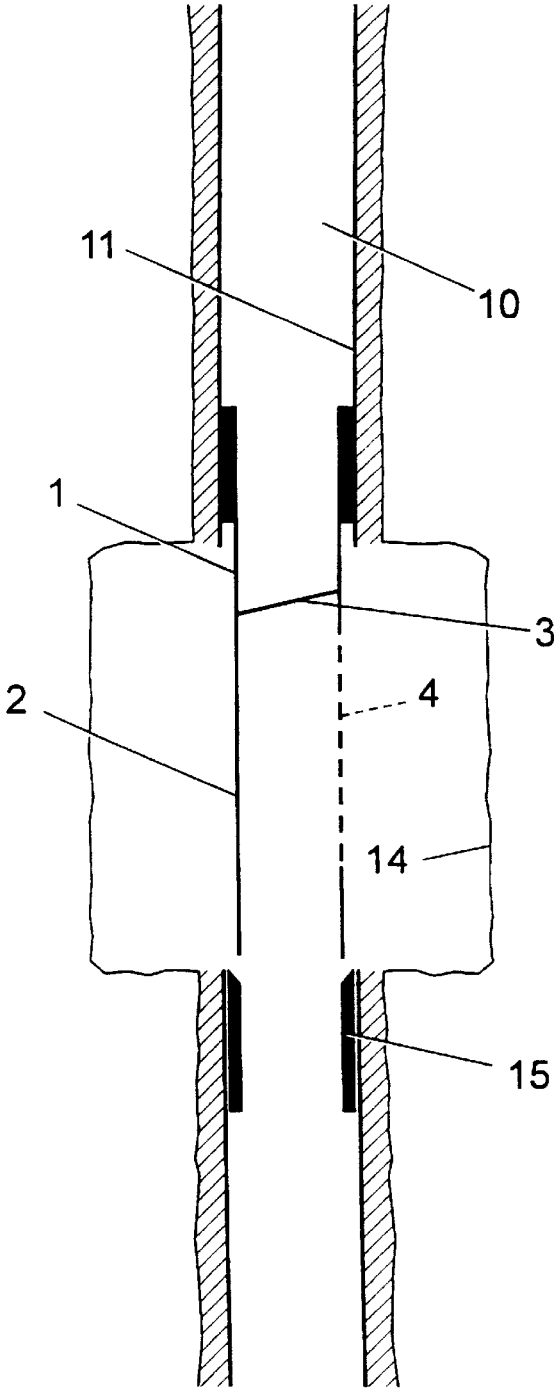
FIG. 10 shows the apparatus of FIG. 1 positioned in the first borehole in the position shown in FIG. 1.
Figure 11:
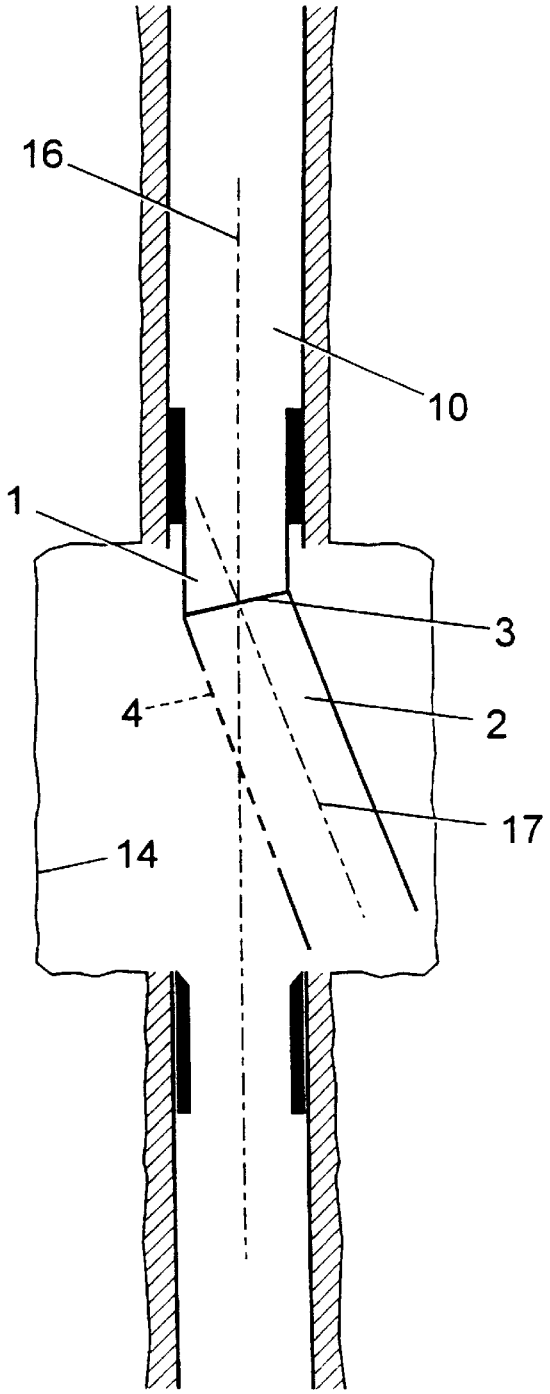
FIG. 11 shows the apparatus of FIGS. 1 and 2 inserted into the first borehole with the second casing section rotated to the position shown in FIG. 2.

The first and second casing sections 1, 2 are then inserted into the borehole 10 in the position shown in FIG. 1 and the first casing section 1 is locked to the casing 11, as shown in FIG. 10. In FIG. 10, the aperture 4 is shown schematically in phantom for clarity. After the casing section 1 has been locked to the casing 11 the second casing section 2 is rotated through 180° relative to the first casing section 1 to the position shown in FIG. 11. The angle $(90°-\alpha)$ of the plane of the rotatable joint 3 relative to the central longitudinal axis 16 is chosen so that when the casing section 2 is rotated to the position shown in FIGS. 2 and 11, the longitudinal axis 17 of the casing section is at an angle of approximately 4° to 5° from the longitudinal axis 16. It should be noted that the longitudinal axis 16 of the first casing section 1 is substantially coincident with the longitudinal axis of the borehole 10 and that when the second casing section 2 is in the position shown in FIGS. 2 and 11, the central longitudinal axis 16 of the first casing section 1 extends through the aperture 4, as shown in FIG. 11.

Figure 12:
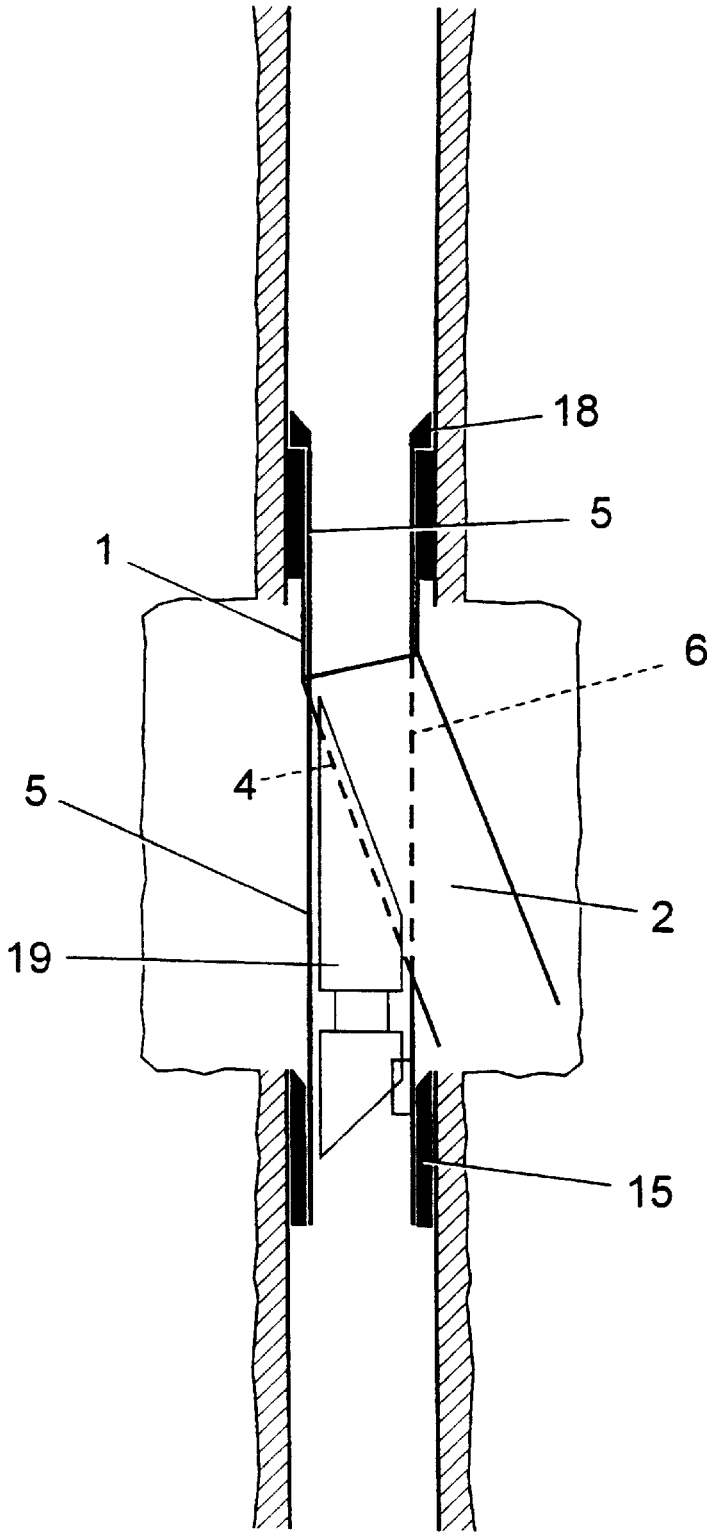
FIG. 12 shows the apparatus shown in FIG. 11 with a third casing section containing a whipstock inserted into a through the first and second casing sections.

The third casing section 5 is then inserted into the first casing section 1 to extend through the aperture 4, as shown in FIGS. 5 and 12. The lower end of the third casing section 5 is supported by the pack-off receptacle 15 and the upper end is supported by a support member 18 attached to the upper end of the third casing section 5 which engages against the top edge of the first casing section 1. The third casing section 5 is inserted into the first casing section 1 and through the aperture 4 with a whipstock 19 preinstalled within the third casing section 5.

Figure 13:
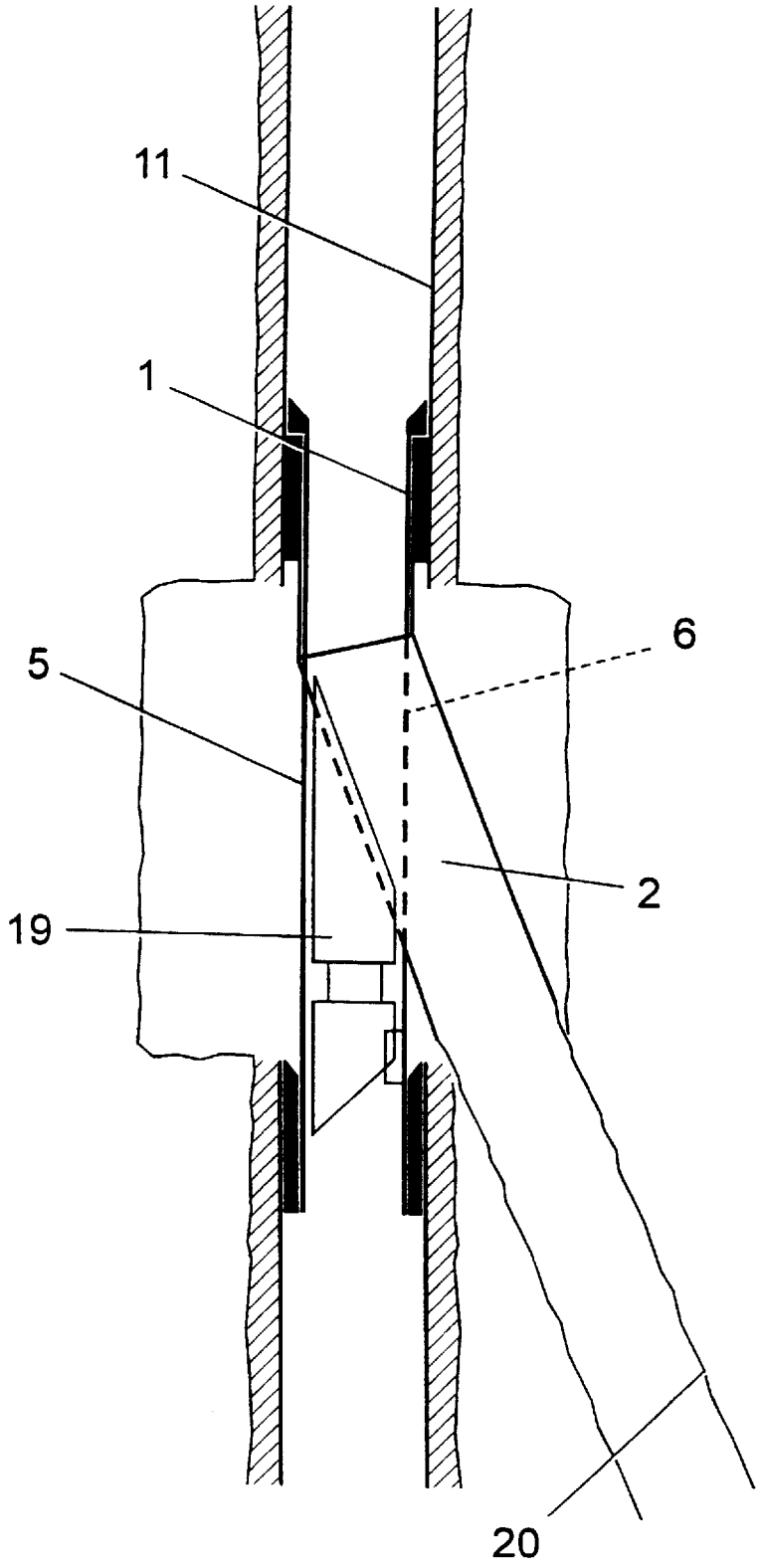
FIG. 13 shows the first borehole and the apparatus of FIG. 12 with a second borehole drilled from the second casing section.
Figure 14:
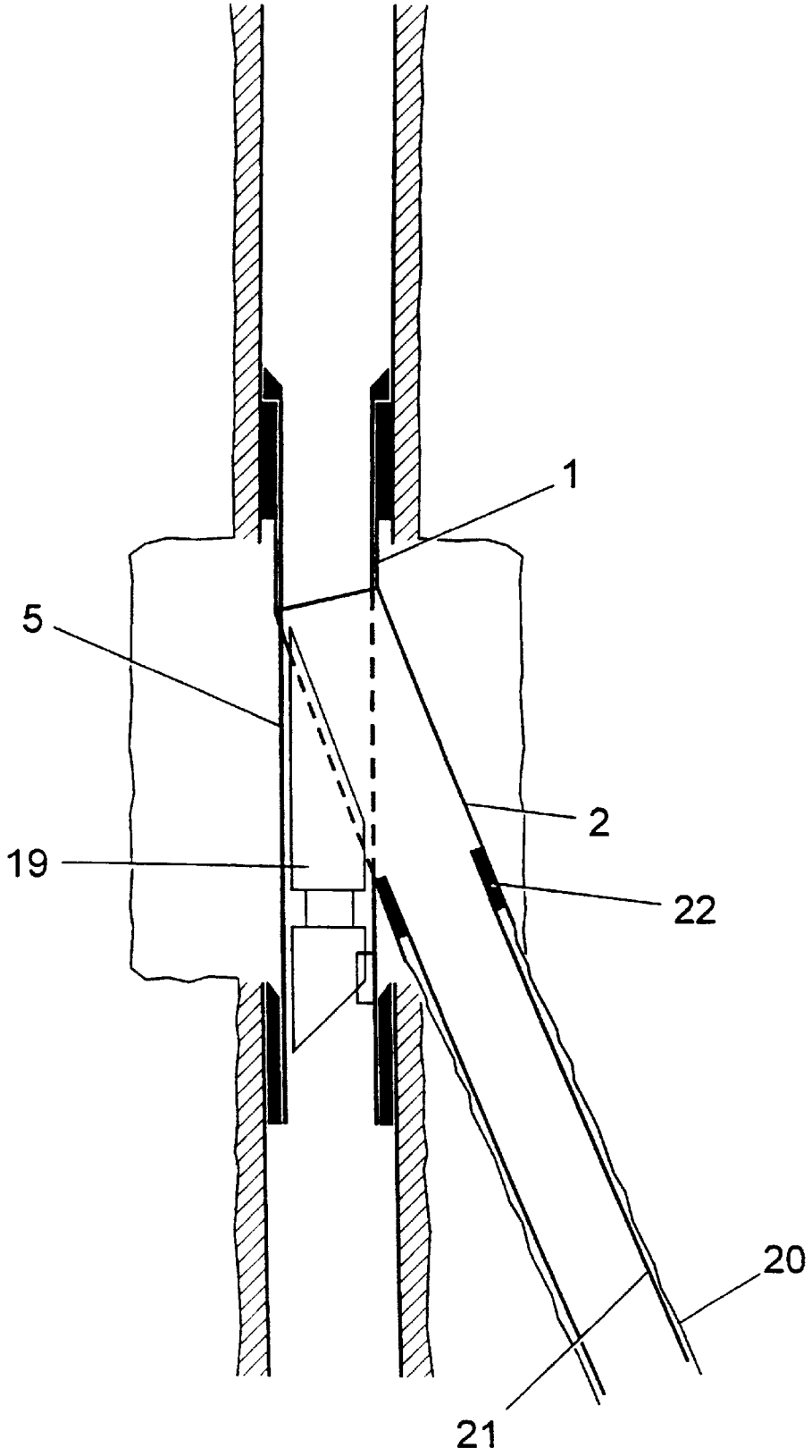
FIG. 14 shows the boreholes of FIG. 13 with a liner inserted into the second borehole and coupled to the second casing section.
Figure 15:
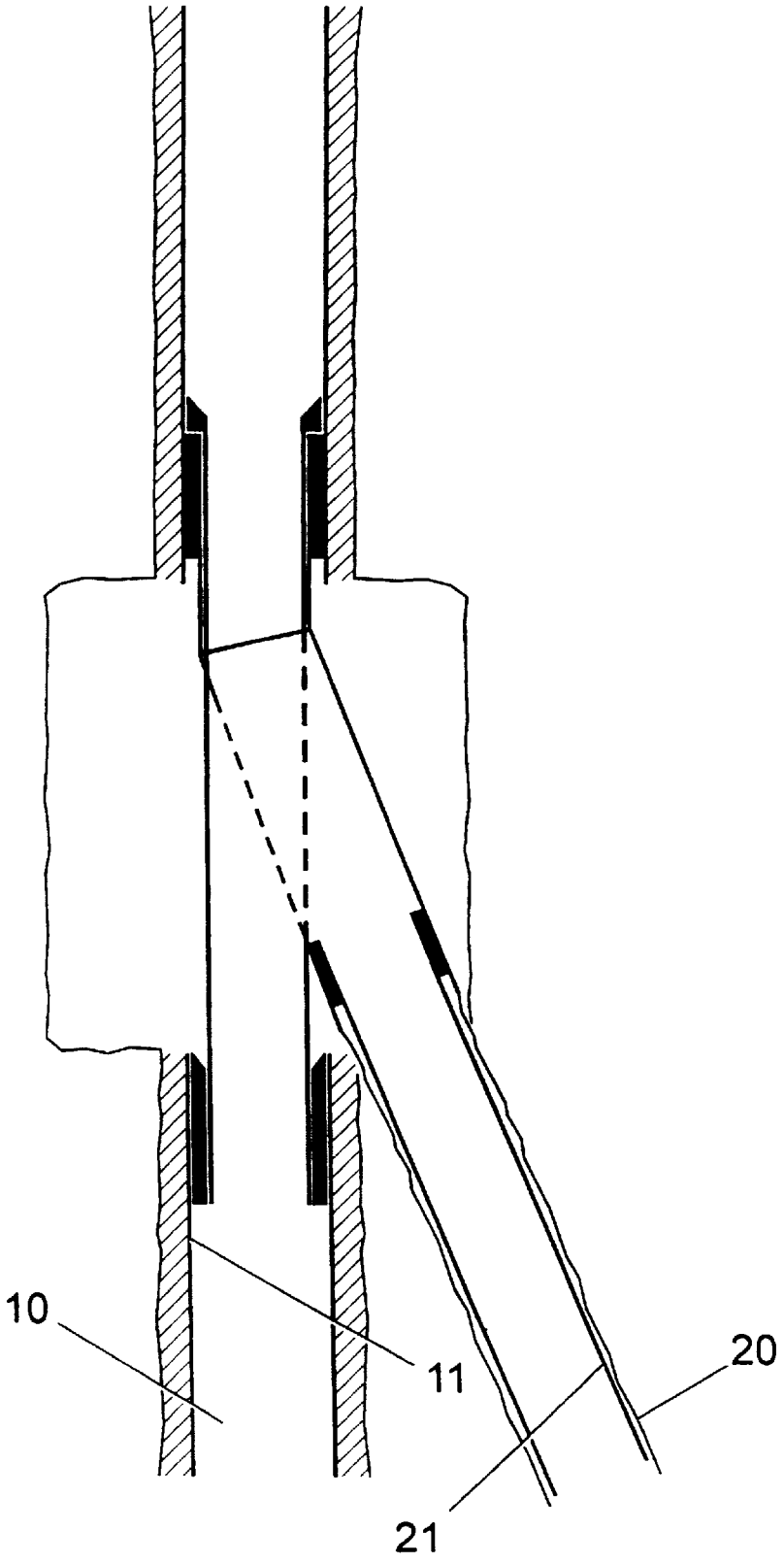
FIG. 15 shows the boreholes of FIG. 14 with the whipstock in the third casing section removed.

With the whipstock 19 in position in the third casing section 5, a drill string may be inserted into the upper end of the casing 11 and thus into the first casing section 1. The whipstock 19 prevents the drill string entering the third casing section 5 and forces the drill string to bend through the aperture 6 in the third casing section 5 and enter the second casing section 2 to drill a second borehole 20, as shown in FIG. 13. After the second borehole 20 has been drilled, a liner 21 is inserted into the borehole 20 through the first and second casing sections 1, 2 and coupled to the second casing section by a pack-off device 22, as shown in FIG. 14. The whipstock 19 may then be removed from the third casing section 5 to permit access to the borehole 10 below the third casing section 5 or access into the second borehole 20 (as shown in FIG. 15).

A number of further lateral boreholes, similar to the second borehole 20 may be formed above the lateral borehole 20 and under-reamed section 14 by carrying out a similar operation as described above for these further lateral boreholes.

In addition, the apparatus can be used for re-entry applications where a lateral well, or a number of lateral wells, are drilled from an existing well to stimulate or increase production from the existing well.

Furthermore, the first and second casing sections may be run attached to the end of the main casing string to drill a lateral well from the end of the mother well.

Advantages of the invention are that the diameter of second borehole (or lateral well) may be similar to the diameter of the first borehole (or mother well); a high pressure seal may be effected between the junction of the second borehole liner and the first borehole casing; and the apparatus is relatively easy and quick to install.

Modifications and improvements may be incorporated without departing from the scope of the invention.

What is claimed is:

1. Apparatus for drilling a second borehole from a first borehole comprising a first casing section and a second casing section, the first and second casing sections being rotatably coupled to each other by a rotatable joint, such that the first and second casing sections may be rotated about the joint from a first position, in which the longitudinal axes of the first and second casing sections are substantially coincident, to a second position in which the longitudinal axis of the first and second casing sections are at a mutually oblique angle, and such that the longitudinal axis of one of the casing sections extends through an aperture in the other casing section when the casing sections are in the second position.

2. Apparatus as claimed in claim 1, wherein the plane of the rotatable joint is at an oblique angle to the longitudinal axis of the casing string adjacent the joint.

3. Apparatus as claimed in claim 1 or claim 2 including a third casing section adapted to be inserted through the said one casing section into the other casing section and exit the other casing section through the aperture in the other casing section when the casing sections are in the second position.

4. Apparatus as claimed in claim 3, wherein the third casing section has an aperture adapted to provide an opening into the second casing section.

5. Apparatus as claimed in claim 4, wherein the third casing section is inserted before the second borehole has been drilled.

6. Apparatus as claimed in claim 1, wherein the apertures in the casing sections are provided with a seal.

7. Apparatus as claimed in claim 6, wherein the seal is elastomeric, metal to metal or is energised when the liner is inserted into the second borehole.

8. A method of drilling a second borehole from a first borehole comprising inserting a casing string comprising a first casing section and a second casing section into the first borehole with the longitudinal axes of the first and second casing sections substantially coincident, rotating the first and second casing sections relative to each other to move the second casing section to a position in which the longitudinal axis of the second casing section is at an oblique angle to the longitudinal axis of the first casing section; inserting a drilling device into the first casing section and causing it to pass into the second casing section, and drilling the second borehole from the second casing section.

9. A method as claimed in claim 8, further including the subsequent step of inserting a liner into the second borehole and coupling the liner to the second casing section.

10. A method as claimed in claim 8 or claim 9, wherein a third casing section is inserted into the borehole.

11. A method as claimed in claim 10, wherein the third casing section is inserted after the installation of the first and second casing sections.

12. A method as claimed in claim 8, further including the initial step of under-reaming a section of the first borehole at which the apparatus is to be located prior to inserting the apparatus into the first borehole.

13. A method as claimed in claim 8, wherein the drilling device is diverted into the second casing section by a diversion device.

14. A method as claimed in claim 13, wherein a third casing section is inserted into the borehole and the diversion device is removed from the third casing section after the second borehole has been drilled.

* * * * *